US005176422A

United States Patent [19]

Canet

[11] Patent Number: 5,176,422

[45] Date of Patent: Jan. 5, 1993

[54] PORTABLE CASE WHICH CAN BE CONVERTED INTO A CHAIR

[76] Inventor: Christine Canet, 12 Cours Balguerie Suttenberg, F-33000 Bordeaux, France

[21] Appl. No.: 618,087

[22] Filed: Nov. 26, 1990

[30] Foreign Application Priority Data

Nov. 28, 1989 [FR] France ..... 89 15642

[51] Int. Cl.[5] ..... A47C 4/52

[52] U.S. Cl. ..... 297/17; 297/325; 297/440; 297/378

[58] Field of Search ..... 297/17, 118, 130, 258, 297/261, 325, 329, 440, 378, 379

[56] References Cited

U.S. PATENT DOCUMENTS

D. 167,514 8/1952 Hicks ..... 297/17 X
2,631,699 3/1953 Schultz ..... 297/17 X
3,092,224 6/1963 O'Neil ..... 297/17 X
3,964,790 6/1976 Bergeron ..... 297/118 X
4,079,992 3/1978 Thrift et al. .
4,742,900 5/1988 Boxhammer ..... 297/17 X
4,778,216 10/1988 Stupakis ..... 297/17

FOREIGN PATENT DOCUMENTS 478049 11/1915 France .

*Primary Examiner*—Peter R. Brown
*Attorney, Agent, or Firm*—Beveridge, DeGrandi & Weilacher

[57] ABSTRACT

The portable case which can be converted into a chair comprises two separable half-shells (1, 2) capable of being fitted back-to-back in an adjustable manner by complementary assembly structure. One of the half-shells (2) comprises two articulated elements (7, 8) mounted about parallel hinges situated on two opposite sides of the half-shell so as to form, in the folded-out position, support surfaces of the chair thus assembled.

6 Claims, 2 Drawing Sheets

PORTABLE CASE WHICH CAN BE CONVERTED INTO A CHAIR

The present invention relates to a portable case which can be converted into a chair.

During recent decades, the growth of medical science has meant an increase in the average lifespan from 45 to 75 years. In France, the percentage of the population aged over 60 has grown from 6.74% in 1950 to 17.60% in 1981.

More medical health care is therefore required for this specific population of elderly people who are not always physically capable of travelling in order to receive health care.

In the particular field of oral health care, dentists visiting the homes of elderly people would constitute an appropriate response to the needs of these people. This requires a movable system adapted not only with respect to the instruments, but also a chair adapted in order to enable the treatment to be carried out in optimum comfort for both the patient and the practitioner.

More generally, the majority of western countries have at the very least one dentist per 5,000 inhabitants. However, in a large number of underdeveloped countries, for example in Somalia, in Tanzania, and in Rwanda, there is less than one qualified native dentist per one million inhabitants. In these countries, in view of the financial resources available for health, the dental surgeon will have to set up in bush clinics or go to the homes of the inhabitants in order to treat the oral complaint.

The need for oral health care for handicapped people should also be mentioned, the handicapped often being penalised by their inability to travel to the dentist.

The object of the present invention is to overcome the abovementioned problems by providing a simple, light and practical portable system for carrying out oral health care outside specialised establishments or dental practices.

The object of the invention is also to provide a portable system which can be used in highly varied fields of use such as humanitarian missions and disaster-site medical care, army medical services and medical aid at sporting and public events.

The portable system according to the invention consists of a convertible case provided with two mutually complementary half-shells. When the case is closed, the two half-shells are fitted face-to-face in order to enclose a space in which, for example, can be arranged an air mattress, a seat for the practitioner, small instruments . . .

According to the invention, the two half-shells can be separated and are each provided on the back with an assembly means. After having separated the two half-shells, the first half-shell is first laid horizontally on the ground with its back uppermost. The second half-shell is then laid back-to-back on the first half-shell, and they are assembled with the aid of the respective assembly means of the two half-shells. An adjustment means is associated with the assembly means in order to adjust the relative position of the assembled half-shells.

The second half-shell comprises a first element articulated about a hinge situated on one side of the half-shell, and capable of being folded into and out of the half-shell, and a second element articulated about a hinge parallel to the first and situated on the opposite side to it.

In the folded-out position of the articulated elements, the unit forms a chair, the base of which consists of the first half-shell and the seat of which consists of the second half-shell completed by the two folded-out articulated elements as surfaces for supporting the legs and the back of the patient. The orientation and the inclination of the seat relative to the base can be adjusted via the assembly means and via the adjustment means. Means for adjusting the inclination of the articulated elements relative to the second half-shell can be provided with the aim of being able to adapt the inclination of the back rest and of the foot rest of the chair. For more comfort, an inflated air mattress can be laid on the support surface of the seat, it being possible for this mattress to be transported uninflated in the initial case before the latter is converted into a chair.

Means for assembling the half-shells can consist of a rib and a groove, complementing each other, provided on the respective backs of the half-shells. The back of the first shell preferably comprises a depression, the shape of which substantially matches that of the back of the second half-shell, with the aim of better distributing the forces to which the half-shells are subjected when a patient is reclining on the chair thus converted.

The adjustment means can be ensured by a locking device which can vary the friction between the assembly means or lock the assembly means by way of an attached element.

The invention will be better understood from studying the detailed description of an illustrative embodiment of the invention, given with no limitation being implied and illustrated by the attached drawings, in which.

Figure 1:
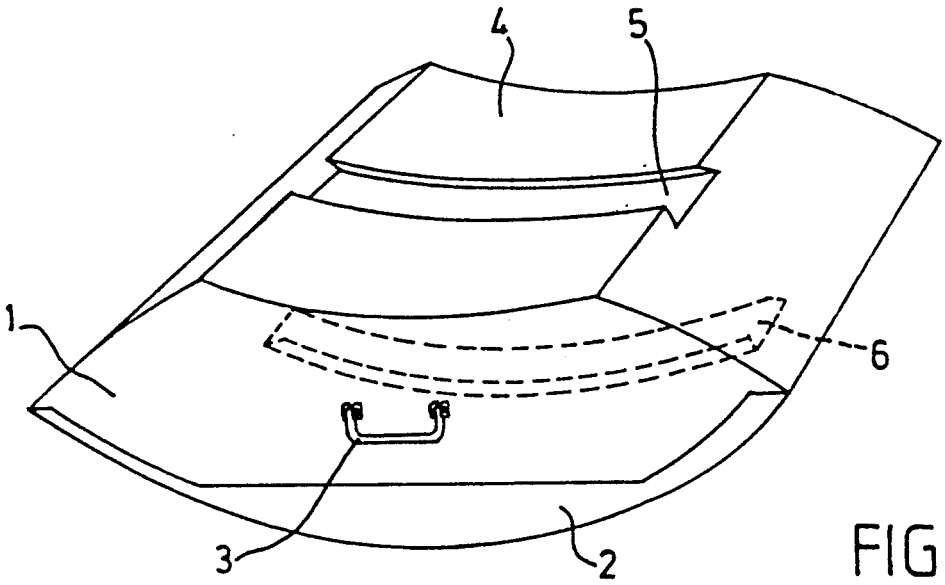
FIG. 1 is a perspective view of the convertible case according to the invention.
Figure 2:
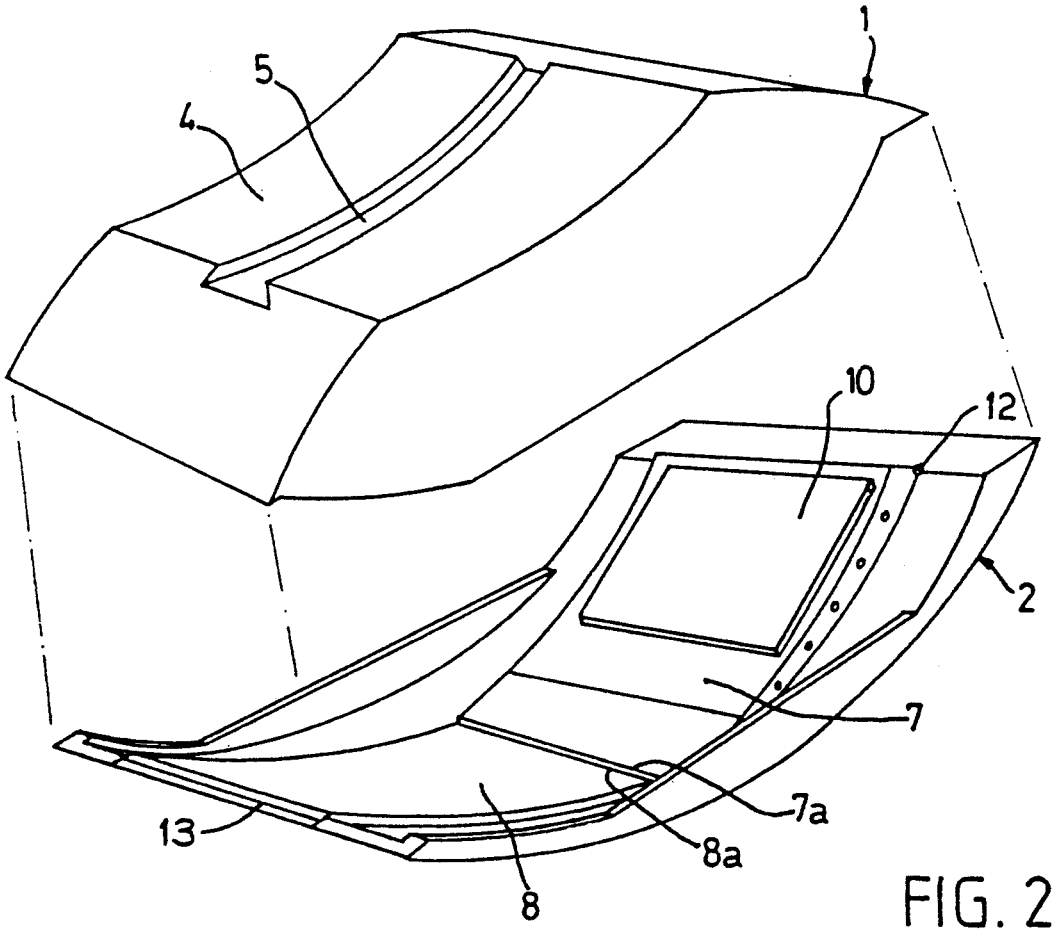
FIG. 2 is an exploded view of the case in FIG. 1 with two separate half-shells.

As illustrated in these figures, the carrying case consists of a first half-shell 1 and of a second half-shell 2, of mutually complementary shape, assembled face-to-face enclosing a space for containing the objects. The case has a substantially ovoid shape and is provided with a handle 3 on a lateral side of the first half-shell.

The first half-shell 1 has on its back a depression 4, the surface of which is curved in the same way as the back of the second half-shell 2. A longitudinal groove 5 is made on the depression 4 of the first half-shell 1. The groove 5 is of constant section and the width of the bottom is greater than the width of its opening. A curved longitudinal rib 6, of a shape complementing the groove 5 of the first half-shell, is provided on the back of the second half-shell 2.

The case is provided with other means, not shown, for holding the two half-shells 1 and 2 together, and for opening the case in the manner of a conventional case.

The second half-shell 2 comprises two articulated elements 7 and 8 mounted opposite each other about parallel hinges which are situated on the two end sides of the half-shell 2. The first element 7 is articulated abut a hinge axis 12 situated on one side of the half-shell, and capable of being folded into and out of the half-shell, and the second element 8 is articulated along a hinge axis 13 which is parallel to the first hinge axis 12 and situated on the opposite side to the hinge axis 12. The articulated elements 7, 8 are preferably made form of curved plates of given length so that, in the folded position, they match the shape of the inner face of the half-shell 2, the two respective free ends 7*a* and 8*a* being situated end-to-end at the bottom of the inner face of the half-shell 2.

In order to effect the conversion of the case into a chair, firstly the half-shells 1 and 2 are separated. Then the first half-shell 1 is placed flat on the ground, the depression 4 of the half-shell 1 facing upwards. The second half-shell 2 is then laid, with its back pointing downwards, on the depression 4 of the first half-shell 1, the curved longitudinal rib 6 on the back of the second half-shell 2 sliding inside the groove 5 of the first half-shell 1. The half-shells 1 and 2 are thus assembled back-to-back with the possibility of altering the inclination of the second half-shell 2 relative to the first half-shell 1 with the aid of the groove 5 and of the rib 6.

Figure 3:
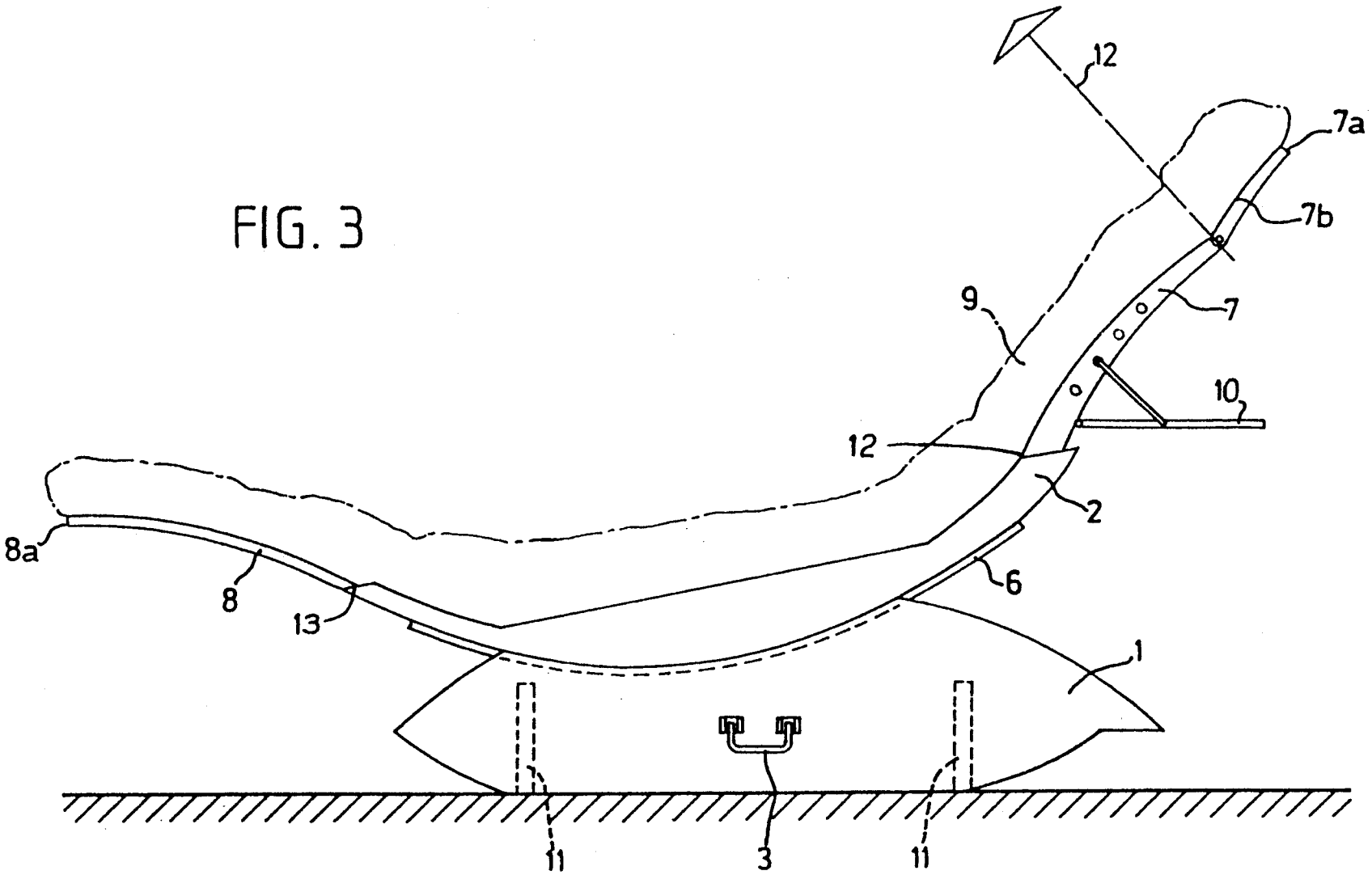
FIG. 3 is a side view of the chair, erected starting from the case in FIGS. 1 and 2.

The first articulated element 7 is then folded out from the second half-shell 2 into a limit position shown in FIG. 3, it being possible for this limit position to be adjusted by an appropriate means, not shown, for altering the inclination of the element 7 relative to the half-shell 2. The same applies to the second articulated element 8. The articulated elements 7 and 8 can comprise locking means for reinforcing their mechanical strength in the folded-out position. A support surface is thus obtained for receiving a patient reclining on the chair.

The chair 9 thus obtained is preferably used in combination with a soft mattress, such as an air mattress, so as to have a more comfortable surface for receiving the patient. This mattress can have handles on the side edges for carrying the patient.

The articulated element 7 can have a pivotable end part 7*b* so as to form an adjustable head-rest support. As shown in FIG. 3, the articulated element 7 can serve as a support for a retractable and removable shelf 10 in order to permit the doctor to put his tools down.

The inclination of the chair can be adjusted by virtue of the play between the rib 6 and the groove 5 provided on the back of the half-shells 1 and 2. This inclination can be locked at indeterminate positions with the aid of any locking means known per se. Moreover, for the purposes of adjusting the height of the chair, the first half-shell 1 can comprise a retractable underframe 11, as illustrated in FIG. 3. A small telescopic lamp can also be provided, mounted on one side of the first articulated element 7 to provide the lighting which the doctor requires for his work.

When the doctor's work is complete, the chair can be converted again into a portable case in which the doctor carries away all his instruments and the deflated air mattress. It thus considerably widens the field of operation in the service of patients.

I claim:

1. A device which includes a case which is convertible into a chair, comprising, a first half-shell;

a second half-shell which is separably mounted on the first half-shell in a case-forming configuration where they are connected together in a front-to-front relationship;

both of said half-shells having backs which include assembly means for mounting the shells in a chair configuration where they are in a back-to-back relationship, said assembly means including:

a depression on the back of the first half-shell which corresponds in shape to the back of the second half-shell, and adjustment means for effecting a change in inclination of the second half-shell relative to the first half-shell, said adjustment means including a groove in one said half-shell and a rib on one said half-shell, said rib lying in said groove.

2. A device according to claim 1, wherein said first half-shell is provided with retractable means for supporting the device and for adjusting the height of the device when it is in its chair configuration.

3. A device which includes a case which is convertible into a chair, comprising, a first half-shell;

a second half-shell which is separably mounted on the first half-shell in a case-forming configuration where they are connected together in a front-to-front relationship;

both of said half-shells having backs which include assembly means for mounting the shells in a chair configuration where they are in a back-to-back relationship, said assembly means including a depression on the back of the first half-shell which corresponds in shape to the back of the second half-shell, said second half-shell including two articulated elements hingedly mounted on opposite sides of the second half-shell, said articulated elements being curved plates which are movable between folded positions where they lie inside the second half-shell at its bottom and folded out positions where they form complementary support surfaces for receiving a person on the second half-shell.

4. A device according to claim 3 wherein the assembly means includes a groove in one said half-shell and a rib on one said half-shell, said rib lying in said groove, said two half-shells being relatively movable to effect a change in inclination of the second half-shell relative to the first half-shell.

5. A device according to claim 3 wherein the first articulated element includes a pivoted end portion.

6. A device which includes a case which is convertible into a chair, comprising, a first half-shell;

a second half-shell which is separably mounted on the first half-shell in a case-forming configuration where they are connected together in a front-to-front relationship;

both of said half-shells having backs which includes assembly means for mounting the shells in a chair configuration where they are in a back-to-back relationship, said assembly means including a depression on the back of the first half-shell which corresponds to the shape of the back of the second half-shell, said first half-shell being provided with retractable means for supporting the device and adjusting the height of the device when it is in the chair configuration.

* * * * *